US008915187B2

(12) United States Patent
Horn et al.

(10) Patent No.: US 8,915,187 B2
(45) Date of Patent: Dec. 23, 2014

(54) EDGE MARKING FOR DOCUMENT IDENTIFICATION

(75) Inventors: Richard T. Horn, Claremont, CA (US); Lynn K. Mello, Pasadena, CA (US)

(73) Assignee: Xerox Corporation, Norwalk, CT (US)

( * ) Notice: Subject to any disclaimer, the term of this patent is extended or adjusted under 35 U.S.C. 154(b) by 2268 days.

(21) Appl. No.: 11/834,822

(22) Filed: Aug. 7, 2007

(65) Prior Publication Data

US 2009/0039583 A1 Feb. 12, 2009

(51) Int. Cl.

| | |
|---|---|
| ***B41F 1/34*** | (2006.01) |
| ***G03G 21/14*** | (2006.01) |
| ***G03G 15/00*** | (2006.01) |

(52) U.S. Cl.

CPC ..... *G03G 21/14* (2013.01); *G03G 15/00* (2013.01); *G03G 2215/00421* (2013.01); *G03G 2215/00578* (2013.01); *G03G 2215/00805* (2013.01)

USPC ..... 101/485; 101/486

(58) Field of Classification Search

USPC ..... 101/485

See application file for complete search history.

(56) References Cited

U.S. PATENT DOCUMENTS

| | | | | |
|---|---|---|---|---|
| 4,427,290 | A * | 1/1984 | Kaye et al. | 355/40 |
| 5,085,417 | A | 2/1992 | Copham | |
| 6,032,004 | A | 2/2000 | Mirabella, Jr. et al. | |
| 6,048,114 | A * | 4/2000 | de Troz | 400/24 |
| 6,335,084 | B1 * | 1/2002 | Biegelsen et al. | 428/192 |
| 6,478,337 | B1 * | 11/2002 | Toda et al. | 283/38 |
| 6,585,163 | B1 | 7/2003 | Meunier et al. | |
| 2002/0135653 | A1 | 9/2002 | Otsuki | |
| 2006/0231997 | A1 | 10/2006 | Meunier | |
| 2007/0154250 | A1 * | 7/2007 | Cahill et al. | 400/24 |

* cited by examiner

*Primary Examiner* — Matthew G Marini

(74) *Attorney, Agent, or Firm* — Gibb & Riley, LLC

(57) ABSTRACT

A method receives a multi-page print job comprising content to be printed on sheets to produce a stack of printed sheets. Each of the sheets comprises sheet sides and sheet edges between the sheet sides, wherein the content is printed on at least one of the sheet sides. The method identifies a side mark to appear on at least one stack side of the stack of printed sheets (the stack side comprises the sheet edges). The method determines locations within the print job of side markings to be printed simultaneously with the content on the sheet sides (a combination of the side markings create the side mark). The method prints the multi-page print job to produce the stack of printed sheets with the side mark on the stack side.

16 Claims, 2 Drawing Sheets

EDGE MARKING FOR DOCUMENT IDENTIFICATION

BACKGROUND AND SUMMARY

Embodiments herein generally relate to systems, methods, services, etc. for providing a tool for use within monochrome, highlight color, or full color environments for the generation of edge barcodes/text/images on printed stacks of sheets that can be set up at the print queue level for all print files that are submitted to that queue.

Customers who print documents in quantity, which are later warehoused for future distribution, must have a method for identifying the stored document for future access. Typically, a barcode identifying the document will be placed on the cover of the document, which requires that the document be handled to access and read the barcode to verify that the correct document has been located and is ready for distribution. Alternatively, the documents can be stored in labeled cartons and the cartons on shelves. Should the documents be stored in the wrong carton and/or shelf, this error could result in loss of time spent to correct the problem or delivery of the wrong product and the additional costs incurred to correct this error.

Besides order fulfillment, periodically the contents in the warehouse must be inventoried. One of the challenges with tracking inventory is keeping an accurate count. If the inventory is warehoused incorrectly or the person performing the count records an incorrect total, the accuracy of the count is in jeopardy requiring that the inventory be justified in some manner. This can cause delays in opening the warehouse for continuing business.

With embodiments herein, placing markings such as a barcode on an unbound edge of a document allows an operator to scan the barcode on yet another surface to validate that they have identified the correct document without time being consumed in handling operations. An automated delivery system can scan the barcode to confirm the correct document has been pulled and to route it to the correct packaging station.

Another consideration of embodiments herein is the utilization of the empty space of a document's unbound edges for the printing of images. These images can represent words, graphics, or numbering in the form of the book title or publisher, logo, series number, or product advertisements to defray publishing costs.

Thus, embodiments herein provide the user a tool to print marks on the sides of stacks of printed content (e.g., at the unbound edge of a bound document). The user can enter a value or image that is rendered into a barcode or a suitable image print stream at a printer controller queue level. This data is printed as a barcode or image at the defined location on each page. With the correctly sized marks placed at the edge of the appropriate number of accumulated pages, a barcode or other image running down an edge can be created. If the document will be trimmed later, the marks are placed where the finished edge location will be.

More specifically, this disclosure presents a method, system, computer program, etc. that receives a multi-page print job. The print job comprises content to be printed on sheets to produce a stack of printed sheets. To be specific with nomenclature herein, each of the sheets is said to have two "sheet sides" and four "sheet edges" between/bordering the sheet sides and the "content" is printed on at least one of the two sheet sides. In other words, a standard rectangular sheet of letter or legal paper has two sheet sides (a front side (first page) and a back side (second page)) upon which printing is performed. Such a sheet also has four sheet edges (a top edge, two side edges, and a bottom edge). While the examples used herein use rectangular flat sheets, one ordinarily skilled in the art would understand that the invention is equally applicable to sheets of different geometric shape (e.g., triangles, curved sheets, etc.).

One feature of embodiments herein is the identification of a "side mark" that will appear on at least one "stack side" of the stack of printed sheets. Again, for nomenclature purposes, the "stack side" is made up of all the exposed sheet edges in the stack and the "side mark" is the barcode, text, image, logo, picture, etc. that will be visible when the stack side is viewed side on. The side mark can be monochrome or color, depending upon the printing capability of the printer being used.

One manner in which the embodiments herein can identify the side mark is based on receiving user input to dynamically identify the side mark. For example, this feature can be included within the print queue processing such that, at the time of adding the print job to a print queue, the user can dynamically select a portion of the content of the print job as the side mark. Alternatively, the user can enter the side mark or identify a file containing the side mark.

Alternatively, the embodiments herein can automatically identify the side mark. For example, the method can copy the side mark from a predetermined location of a predetermined page of the print job. Thus, the method can copy a barcode from a specific predetermined location of the cover page of a print job as the side mark to automatically duplicate the barcode on the stack side. Similarly, the embodiments herein can automatically copy the title, author, serial number, initial image, etc. from the content to automatically identify such an item as the side mark to be placed on the stack side.

With respect to the manner in which the side mark is actually printed, the method determines locations within the print job of "side markings." The methods herein do not actually print the side markings directly on the sheet edges, but instead the side markings are printed simultaneously with the content on the sheet sides. The locations selected for the side markings places the side markings along regions of the sheets where the sheet sides meet the sheet edges (on the sheet sides along the sheet edges). By locating the side markings at the edges of the sheet sides, a certain amount of the toner or ink on the sheet sides bleeds through to the sheet edges and is visible when the sheets are viewed edge on. The combination of the individual side markings actually creates the side mark in a similar manner that individual pixels create images in display and printing devices.

However, one feature is that the embodiments herein can dynamically determine the locations within the print job of such side markings. More specifically, embodiments herein calculate the height of the stack of printed sheets based on the number of sheets in the print job and the thickness of the sheets. With the height of the stack of printed sheets known, the method scales the side mark by adjusting the locations of the side markings such that the resulting side mark is centered along the stack side and is not distorted.

Once the foregoing is performed, the method can easily print the multi-page print job to produce the stack of printed sheets with the side mark on the stack side. These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

As discussed above, embodiments herein provide the user a tool to print marks on the sides of stacks of printed content (e.g., at the unbound edge of a bound document). The user can enter a value or image that is rendered into a barcode or a suitable image print stream at a printer controller queue level. This data is printed as a barcode or image at the defined location on each page. With the correctly sized marks placed at the edge of the appropriate number of accumulated pages, a barcode or other image running down an edge can be created.

Figure 1:
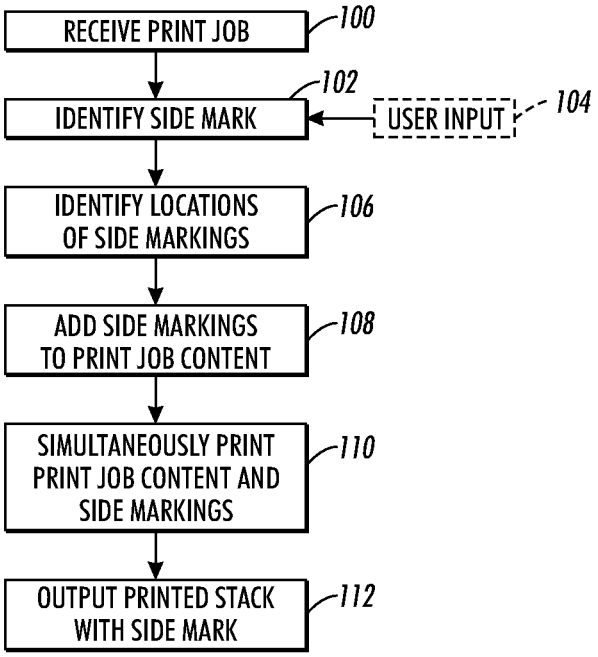
FIG. 1 is a flow diagram illustrating embodiments herein.
Figure 3:
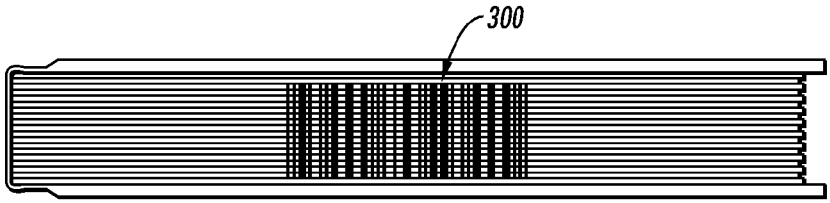
FIG. 3 is a schematic diagram of a stack of printed sheets with a side mark.
Figure 4:
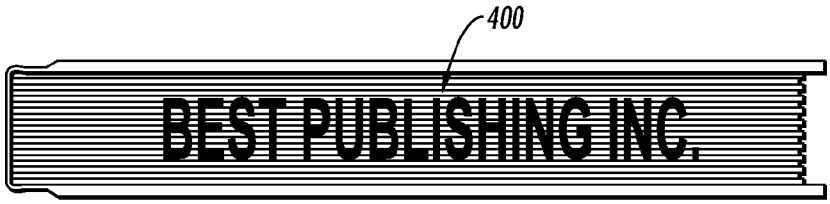
FIG. 4 is a schematic diagram of a stack of printed sheets with a side mark.

As shown in flowchart form in FIG. 1, the methods herein receive a multi-page print job in item 100. The print job comprises content to be printed on sheets to produce a stack of printed sheets. FIGS. 3 and 4 illustrate two stacks of sheets 300 and 400.

As mentioned above, in some examples herein each of the sheets is said to have two "sheet sides" and four "sheet edges" between/bordering the sheet sides. The "content" of the print job is printed on at least one of the two sheet sides. In one example, a standard rectangular sheet of letter or legal paper has two sheet sides (a front side (first page) and a back side (second page)) upon which printing is performed. Such a sheet also has four sheet edges (a top edge, two side edges, and a bottom edge). While the examples used herein use rectangular flat sheets, one ordinarily skilled in the art would understand that the invention is equally applicable to sheets of different geometric shape (e.g., triangles, curved sheets, etc.).

In item 102, a "side mark" that will appear on at least one "stack side" of the stack of printed sheets is identified. Again, the "stack side" is made up of all the exposed sheet edges in the stack and the "side mark" is the barcode, text, image, logo, picture, etc. that will be visible when the stack side is viewed side on. FIGS. 3 and 4 illustrate two exemplary side marks 302 and 402. Item 302 is a barcode and item 402 is a logo, text, title, etc. The side mark can be monochrome or color, depending upon the printing capability of the printer being used.

One manner in which the embodiments herein can identify the side mark in item 102 is based on receiving user input 104 to dynamically identify the side mark. For example, this feature can be included within the print queue processing such that at the time of adding the print job to a print queue the user can dynamically select a portion of the content of the print job as the side mark. Alternatively, the user can manually enter the side mark (through typing, copy and paste operations, etc.) or identify a file containing the side mark (e.g., a file containing an image or logo).

Alternatively, the embodiments herein can automatically identify the side mark. For example, the method can copy the side mark from a predetermined location of a predetermined page of the print job. Thus, the method can copy a barcode from a specific predetermined location of the cover page of a print job as the side mark to automatically duplicate the barcode on the stack side. Such predetermined locations can be established according to the use of previously designed forms and similar document formatting schemes.

Similarly, the embodiments herein can automatically copy the title, author, serial number, initial image, etc. from the content of the print job to automatically identify such an item as the side mark to be placed on the stack side. Thus, this aspect of the methods herein can simply take the first few words, the first image, etc. of the content as the side mark. Alternatively, the methods can search the content for any specific keyword, such as "title", "author", "summary", etc. and take the text immediately following such a keyword as the side mark to place the title, author, etc. along the side of the stack of sheets.

With respect to the manner in which the side mark is actually printed, the method determines locations within the print job of "side markings" in item 106. As discussed above, the methods herein do not actually print the side markings directly on the sheet edges, but instead the side markings are printed simultaneously with the print job content on the sheet sides. The locations selected for the side markings places the side markings along regions of the sheets where the sheet sides meet the sheet edges (on the sheet sides along the sheet edges). By locating the side markings at the edges of the sheet sides, a certain amount of toner, ink, or other marking material (including magnetic marking material) on the sheet sides bleeds through to the sheet edges (or is actually indirectly printed on a part of the sheet edge) and is visible when the sheets are viewed edge on. The combination of the individual side markings actually creates the side mark in a similar manner that individual pixels create images in display and printing devices. The details of printing on the sheet sides at the sheet edges is discussed in U.S. Patent Publications 2002/0135653 and 2006/0231997 and U.S. Pat. Nos. 5,085,417 and 6,585,163 (all of which are fully incorporated herein by reference) and a detailed discussion of such methods and systems is omitted herefrom to maintain focus on the salient features of the embodiments herein.

In one alternative, the embodiments herein can dynamically determine the locations within the print job of such side markings in item 106. More specifically, embodiments herein can calculate the height of the stack of printed sheets based on the number of sheets in the print job and the thickness of the sheets. With the height of the stack of printed sheets known, the method scales the side mark to fit within the available space (with an appropriate border space) and adjusts the locations of the side markings such that the resulting side mark can be centered along the stack side and is not distorted.

Alternatively, the placement location of the barcode or image in item 106 may be specified either by receiving user input (typing in) of the "X" and "Y" coordinates or selecting an appropriate pointing device in the graphic user interface to move the starting point on a simulated edge image. A graphic can be used to show where on the stack side the side image will be placed. If the document will be trimmed later, the marks are placed where the finished edge location will be after trimming.

Once the foregoing is performed, the method can easily add the side markings to the content of the print job in item 108. As mentioned previously, the method simultaneously prints the print job content and the side markings (in item 110) to output the stack of printed sheets with the side mark on the stack side (item 112).

Figure 2:
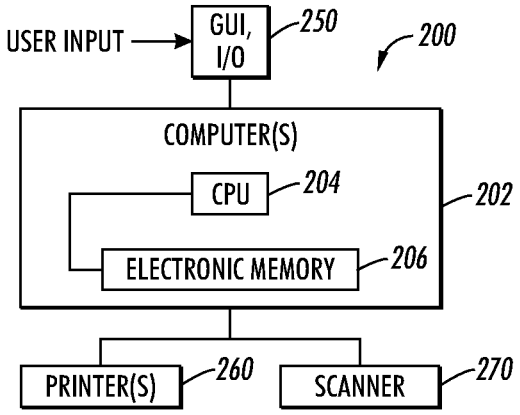
FIG. 2 is a schematic representation of a system embodiment herein.

Another embodiment, shown in FIG. 2, comprises a system 200 that includes a central processing unit 204 (within a device, such as a printer or computer 202) and graphic user interface 250. The graphic user interface can comprise any format, whether now known or developed in the future. For example, the user inputs 104 could be received when the options for a common print queue, such as PostScript, (available from Adobe Systems Incorporated, San Jose, Calif., USA). The system 200 also includes a scanner 270 operatively connected to the graphic user interface 250 through the computer 202 and central processing unit 202 into which the side mark could be scanned. A memory 206 is provided in the system 200 operatively connected to the scanner 270 and the processor 204.

The graphic user interface 250 is adapted to receive input from the user 104, and such input could comprise the side mark, the location of the side mark, preferences regarding the side mark, etc. (which could be stored in the electronic memory 206 or which could be accessed through a network connected to the input/output 250).

Additionally, various computerized devices are mentioned herein. Computers that include input/output devices, memories, processors, antenna, programmable switches, etc. are readily available devices produced by manufactures such as International Business Machines Corporation, Armonk N.Y., USA and Apple Computer Co., Cupertino Calif., USA. Such chips, antenna, switches, etc. commonly include input/output devices, power supplies, processors, electronic storage memories, wiring, etc., the details of which are omitted herefrom to allow the reader to focus on the salient aspects of the embodiments described herein.

The word "printer" as used herein encompasses any apparatus, such as a digital copier, bookmaking machine, facsimile machine, multi-function machine, etc. which performs a print outputting function for any purpose. The details of printers, printing engines, etc. are well-known by those ordinarily skilled in the art and are discussed in, for example, U.S. Pat. No. 6,032,004, the complete disclosure of which is fully incorporated herein by reference. Printers are readily available devices produced by manufactures such as Xerox Corporation, Stamford, Conn., USA. Such printers commonly include input/output, power supplies, processors, media movement devices, marking devices etc., the details of which are omitted herefrom to allow the reader to focus on the salient aspects of the embodiments described herein.

As shown above, with embodiments herein, placing markings such as a barcode on an unbound edge of a document allows an operator to scan the barcode on yet another surface to validate that they have identified the correct document without time being consumed in handling operations. An automated delivery system can scan the barcode to confirm that the correct document has been pulled and to route it to the correct packaging station. Another feature of embodiments herein is the utilization of the empty space of a document's unbound edges for the printing of images. These images can represent words, graphics, or numbering in the form of the book title or publisher, logo, series number, or product advertisements to defray publishing costs. Thus, embodiments herein provide the user a tool to print marks on the sides of stacks of printed content (e.g., at the unbound edge of a bound document). The user can enter a value or image that is rendered into a barcode or a suitable image print stream at a printer controller queue level.

All foregoing embodiments are specifically applicable to electrostatographic and/or xerographic machines and/or processes as well as to software programs stored on the electronic memory (computer usable data carrier) and to services whereby the foregoing methods are provided to others for a service fee. It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof.

What is claimed is:

1. A method comprising:

receiving a multi-page print job comprising content to be printed on sheets to produce a stack of printed sheets, wherein each of said sheets comprises sheet sides and sheet edges between said sheet sides, wherein said content is printed on at least one of said sheet sides;

automatically, and without user input, identifying a side mark from said content of said print job to appear on at least one stack side of said stack of printed sheets using a computerized device, wherein said stack side comprises said sheet edges;

determining locations within said print job of side markings to be printed simultaneously with said content on said sheet sides using said computerized device, wherein a combination of said side markings create said side mark; and printing said multi-page print job to produce said stack of printed sheets with said side mark on said stack side.

2. The method according to claim 1, wherein said side mark comprises a colorized mark.

3. The method according to claim 1, wherein said determining of said locations of said side markings places said side markings along regions of said sheets where said sheet sides meet said sheet edges.

4. The method according to claim 1, wherein said side markings are visible from observing said sheet edges.

5. A method comprising:

receiving a multi-page print job comprising content to be printed on sheets to produce a stack of printed sheets, wherein each of said sheets comprises sheet sides and sheet edges between said sheet sides, wherein said content is printed on at least one of said sheet sides;

automatically, and without user input, identifying a side mark barcode from a barcode in said content of said print job to appear on at least one stack side of said stack of printed sheets using a computerized device, wherein said stack side comprises said sheet edges;

dynamically determining locations within said print job of side markings to be printed simultaneously with said content on said sheet sides, wherein a combination of said side markings create said side mark barcode using said computerized device, wherein said determining of said locations comprises calculating a height of said stack of printed sheets and adjusting locations of said side such that said side mark barcode is centered along said stack side; and printing said multi-page print job to produce said stack of printed sheets with said side mark barcode on said stack side.

6. The method according to claim 5, wherein said side mark barcode comprises a colorized mark.

7. The method according to claim 5, wherein said determining of said locations of said side markings places said side markings along regions of said sheets where said sheet sides meet said sheet edges.

8. The method according to claim 5, wherein said side markings are visible from observing said sheet edges.

9. A method comprising:

receiving a multi-page print job comprising content to be printed on sheets to produce a stack of printed sheets, wherein each of said sheets comprises sheet sides and sheet edges between said sheet sides, wherein said content is printed on at least one of said sheet sides;

automatically, and without user input, identifying a side mark to appear on at least one stack side of said stack of printed sheets using a computerized device, wherein said stack side comprises said sheet edges, and wherein said automatically identifying comprises automatically copying said side mark from said content of said print job on a predetermined location of a predetermined page of said print job;

determining locations within said print job of side markings to be printed simultaneously with said content on said sheet sides using said computerized device, wherein a combination of said side markings create said side mark; and printing said multi-page print job to produce said stack of printed sheets with said side mark on said stack side.

10. The method according to claim 9, wherein said side mark comprises a colorized mark.

11. The method according to claim 9, wherein said determining of said locations of said side markings places said side markings along regions of said sheets where said sheet sides meet said sheet edges.

12. The method according to claim 9, wherein said side markings are visible from observing said sheet edges.

13. A computer program storage device comprising:

a non-volatile computer-usable data medium storing instructions that, when executed by a computer, cause said computer to perform a method comprising:

receiving a multi-page print job comprising content to be printed on sheets to produce a stack of printed sheets, wherein each of said sheets comprises sheet sides and sheet edges between said sheet sides, wherein said content is printed on at least one of said sheet sides;

automatically, and without user input, identifying a side mark from said content of said print job to appear on at least one stack side of said stack of printed sheets, wherein said stack side comprises said sheet edges;

determining locations within said print job of side markings to be printed simultaneously with said content on said sheet sides, wherein a combination of said side markings create said side mark; and printing said multi-page print job to produce said stack of printed sheets with said side mark on said stack side.

14. The computer program product according to claim 13, wherein said side mark comprises a colorized mark.

15. The computer program product according to claim 13, wherein said determining of said locations of said side markings places said side markings along regions of said sheets where said sheet sides meet said sheet edges.

16. The computer program product according to claim 13, wherein said side markings are visible from observing said sheet edges.

* * * * *